US005538781A

United States Patent [19]

Rao et al.

[11] Patent Number: 5,538,781

[45] Date of Patent: Jul. 23, 1996

[54] COMPOSITE REINFORCING FABRIC

[75] Inventors: Nippani R. Rao, Farmington Hills; Roy H. Sjoberg, Bloomfield Hills, both of Mich.

[73] Assignee: Chrysler Corporation, Auburn Hills, Mich.

[21] Appl. No.: 334,900

[22] Filed: Nov. 7, 1994

[51] Int. Cl.[6] ..... D03D 15/02; D03D 15/00; D03D 13/00; B32B 7/00

[52] U.S. Cl. ..... 428/229; 139/420 R; 139/425 R; 139/420 A; 428/257; 428/902

[58] Field of Search ..... 428/229, 257, 428/902; 139/420 R, 425 R, 420 A

[56] References Cited

U.S. PATENT DOCUMENTS

| | | | |
|---|---|---|---|
| 3,733,239 | 5/1973 | George | 428/257 |
| 4,368,234 | 1/1983 | Palmer et al. | 428/245 |
| 4,379,798 | 4/1983 | Palmer et al. | 428/113 |
| 4,513,055 | 4/1985 | Leibowitz | 428/245 |
| 4,536,438 | 8/1985 | Bishop et al. | 428/246 |
| 4,983,433 | 1/1991 | Shirasaki | 422/36.1 |
| 5,100,713 | 3/1992 | Homma et al. | 428/102 |
| 5,168,006 | 12/1992 | Inoguchi et al. | 428/245 |
| 5,206,078 | 4/1993 | Inoguchi et al. | 428/225 |
| 5,256,475 | 10/1993 | Koyanagi et al. | 428/225 |
| 5,304,414 | 4/1994 | Bainbridge et al. | 428/229 |

OTHER PUBLICATIONS

Modern Plastics Mid–Oct. 1991 Issue, Author: PPG Industries., Inc., Fiber Glass Products.

*Primary Examiner*—James D. Withers
*Attorney, Agent, or Firm*—Margaret A. Dobrowitsky

[57] ABSTRACT

An improved reinforcing fabric that is woven of alternating fiber yarns of polyaramid, carbon and glass in both the warp and the weft directions such that a fabric of superior impact, tensile, compression and flexural properties is obtained.

4 Claims, 1 Drawing Sheet

COMPOSITE REINFORCING FABRIC

FIELD OF THE INVENTION

The present invention generally relates to a composite reinforcing fabric and more particularly, relates to a composite reinforcing fabric woven by an organic fiber yarn and at least one inorganic fiber yarn in both the warp and the weft directions.

BACKGROUND OF THE INVENTION

In the molding of reinforced plastic parts, fabric insert is frequently used to improve the strength and the modules of a molded part. Molded reinforced plastic parts have been used in the automotive industry where automobile body members are designed and manufactured by such techniques. For instance, in an automobile body member that requires high stiffness, high modules and controlled dimensional stability, a reinforcing fabric is frequently placed in a mold cavity to be encapsulated by a molding resin. Fabrics of either woven or non-woven construction can be used in such reinforcing applications. Reinforcing mats formed of various fibers can also be used.

Reinforcing filamentary yarns are often used in weaving a fabric for molding a fabric reinforced polymeric composite part. The fabric is constructed as an ordinary biaxially woven fabric where the size and density of the warp and the weft are both the same in both directions and the warp and the weft crossing each other at right angle.

Reinforcing filamentary yarns of either organic or inorganic nature have been used in reinforced polymeric composite parts. The reinforcements are usually light weight as well as superior in tensile, compression and flexural properties. A polymeric composite part reinforced by such fabrics has been used as a structural member in place of a conventional metal part in various applications. For instance, a polymeric composite part reinforced with fabrics of carbon fibers has excellent light-weight property in addition to other desirable mechanical properties. Carbon fibers have been widely used as the structural reinforcement in the aircraft and aerospace industries for these reasons.

However, a drawback of using carbon fibers as the reinforcement in a plastic part is the fact that carbon fibers render the plastic brittle upon impact and produces a catastrophic failure mode where pieces are shattered upon breakage. This type of failure mode would not be permitted in the application of an automobile body part.

It is therefore an object of the present invention to provide an improved reinforcing fabric that does not have the shortcomings of the prior art fabrics.

It is another object of the present invention to provide an improved reinforcing fabric that is woven by an organic fiber yarn and at least one inorganic fiber yarn such that the fabric has superior impact, tensile, compression and flexural properties.

It is a further object of the present invention to provide an improved reinforcing fabric that is woven by a polyaramid fiber yarn and at least one inorganic fiber yarn such as glass or carbon to achieve a fabric that has superior physical properties.

It is yet another object of the present invention to provide an improved reinforcing fabric that is woven in both the warp and the weft directions by alternating polyaramid, carbon and glass fiber yarns to achieve a fabric having superior reinforcing properties.

It is still another object of the present invention to provide an improved reinforcing fabric that is woven of alternating polyaramid, glass and carbon fibers in both the warp and the weft directions such that an isotropic composite part can be produced.

SUMMARY OF THE INVENTION

In accordance with the present invention, an improved reinforcing fabric that is woven of an organic fiber yarn and at least one inorganic fiber yarn in both the warp and the weft directions is provided.

In the preferred embodiment, alternating fiber yarns of polyaramid, carbon and glass are woven in both the warp and the weft directions such that a fabric of superior impact, tensile, compression and flexural properties is obtained. Furthermore, since the same alternating fiber yarn combination is used in both the warp and the weft directions, the physical properties of the reinforcing fabric in both directions are exactly the same. As a result, a polymeric composite part molded from such a reinforcing fabric has desirable isotropic and non-directional physical properties.

In alternate embodiments, an improved reinforcing fabric woven of an organic fiber yarn and three inorganic fiber yarns in an alternating pattern or an organic fiber yarn and an inorganic fiber yarn in an alternating pattern in both the warp and the weft directions is provided. In the latter embodiment, a combination of either a polyaramid and carbon fiber yarns or a polyaramid and glass fiber yarns can be used. This may be a lower cost alternative to the preferred embodiment which consists of three different yarns due to a simpler woven process.

The present invention is also directed to a method of making a woven fabric consisting of an organic fiber yarn and at least one inorganic fiber yarn in both the warp and the weft directions.

The present invention is further directed to a polymeric composite part molded by a process of encapsulating a reinforcing fabric that is woven by an organic fiber yarn and at least one inorganic fiber yarn in both the warp and the weft directions.

BRIEF DESCRIPTION OF THE DRAWINGS

Other objects, features and advantages of the present invention will become apparent upon consideration of the specification and the appendix drawings, in which.

DETAILED DESCRIPTION OF THE EMBODIMENTS

Figure 1:
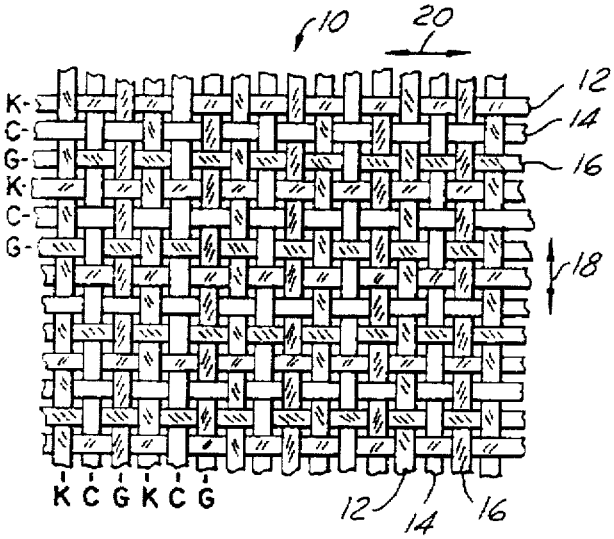
FIG. 1 is a plane view of the present invention reinforcing fabric woven of three different reinforcing fiber yarns of polyaramid, carbon and glass.

The present invention discloses an improved reinforcing fabric woven of an organic fiber yarn and at least one inorganic fiber yarn in the same alternating sequence in both the warp and the weft directions.

The organic fiber yarn utilized in the present invention is a polyaramid fiber yarn. Polyaramid is the generic term for aromatic polyaramid fibers. It has outstanding heat resistance and is used extensively in electrical and protective apparel applications and in composite sandwich structures. The first organic fiber with tensile strength and modules high enough to be used as a reinforcing fiber in advanced composites was introduced in the early 1970's by Dupont under the tradename of Kevlar®.

High strength aramid has a linear, straight rod like polymer chain because of the para-oriented bonding of aromatic rings. Aramid fibers are distinguished by low density, high tensile strength, a range of stiffness, good toughness and a metal-like compressive stress-strain behavior. Fiber density of 1.44 gm/cc is about 40% lower than glass fibers and about 20% lower than commonly used carbon fibers. Filament tensile strength range from 500 to $600\times10^3$ psi and moduli from 12 to $25\times10^6$ psi. Aramid composites exhibit ductile behavior in compression and bending with considerable energy absorption. Aramid fibers also have high thermal stability, low dielectric property and good chemical resistance. Major fiber forms available from the commercial source are continuous filament yarns, rovings, chop fibers and pulp. Kevlar® yarns range from very fine 55 denier to 3,000 denier. Kevlar® 49 which has a higher modulus is the primary type of aramid fibers used today in reinforced plastics.

The inorganic fiber yarns utilized in the present invention can be selected from carbon fibers, glass fibers, nickel coated carbon fibers and any other suitable inorganic fibers. Carbon fibers are fine filaments composed largely of elemental carbon with structures and properties varying from those of amorphous carbon to those of well-developed crystalline graphite. Carbon fibers have a very wide range of physical and chemical properties. For instance, the stiffness or Young's modulus varies between about 5 million psi to about 100 million psi.

The density of carbon is low while the ratio of stiffness-to-density is very high for some carbon fibers. By using the presently available manufacturing technology, the highest fiber strength are obtained for fibers in the intermediate stiffness range from 30 to 40 million psi. Fibers of this type have the most useful balance of mechanical properties and are by far the most widely used variety. Intermediate and high modulus carbon fibers can be supplied in the form of non-twisted yarns. Major carbon fiber suppliers are Amoco Performance Products, Ashland Carbon Fibers, BASF Structural Materials and Akzo Carbon Fibers.

Another inorganic fiber utilized in the present invention is glass fibers. Glass fibers are well known reinforcing fibers that have been used in reinforced plastics for many years. A calcium-alumina-borosilicate composition of E-glass fiber is the most popular reinforcement used in polymer matrix composites because of its good balance of electrical and mechanical properties and costs. E-glass has a density of 0,094 lb./cu. in., an elastic modulus of $10.5\times10^6$ psi and a commercial static tensile strength over 300,000 psi. Glass fiber reinforcements are available in continuous forms as uni-directional roving which is suitable for use in the present invention.

Other inorganic fibers that are also suitable for the present invention are the types such as nickel coated carbon fibers which can be used for the special purpose of EMI or RF shielding.

The present invention utilizes the best physical properties of three different kind of fibers namely, an organic fiber of polyaramid and at least one inorganic fiber of carbon, glass, or nickel coated carbon fibers. A novel reinforcing fabric can be woven from polyaramid, carbon and glass fiber yarns in alternating order in both the warp and the weft directions to provide a uniform or isotropic property of a polymeric reinforced composite part.

The unique combination of these three fibers provides a superior energy absorbing property under impact and the light-weight property from the polyaramid fiber, a high stiffness and high modulus property from the carbon fibers and a low cost and good physical properties from the glass fibers. The ratio of the fiber yarns can be designed to the specific requirement of each application i.e., a specific requirement of high impact, of high stiffness, or of low cost. The concept of the present invention novel fabric can be easily extended to other suitable fibers depending on the properties desired in the final product.

Referring initially to FIG. 1, wherein a plane view of the present invention in a preferred embodiment is shown. An improved fabric 10 is woven by alternating polyaramid fiber yarns 12 (indicated by K), carbon fiber yarns 14 (indicated by C) and glass fiber yarns 16 (indicated by G) in both the warp 18 (vertical) and the weft 20 (horizontal) directions. The fabric 10 is constructed as a single ply plain weave with the same number of fiber yarns arranged in the same alternating sequence in the warp 18 and in the weft 20 direction. The fabric 10 has 12×12 ends per inch warp and weft. In both directions, the fiber yarns consist of T300 3k carbon, 1140 denier Kevlar® and H25 I/O E glass. The aerial weight of fabric 10 is 4.9 ounces per square yard.

The hybrid fabric 10, i.e., a Kevlar®/carbon/glass fabric, allows the manufacture of a composite vehicle member with properties reflective of the ratio of the individual fibers. The fabric contains Kevlar®/carbon/glass rows of fiber yarns in both the warp and the weft directions to provide uniform (isotropic) properties of the composite member. The unique combination of Kevlar®/carbon/glass provides the energy absorbing property upon impact and the weight reduction potential derived from Kevlar®, the high stiffness and the high modulus from carbon and the low cost from glass. The ratio of Kevlar®/carbon/glass can be designed to suit each specific application, i.e. the need for a specific property such as impact, strength, stiffness or cost. The technique taught by the present invention can be extended to any other fiber yarns depending on the specific property desired in the composite member. For instance, a nickel coated carbon fiber yarn may be utilized when the property of EMI/RFI shielding is desired.

The forming process for the composite member can be a resin transfer molding process, a compression molding process, an injection molding process or any other suitable forming processes. These techniques are well described in the literature. The various polymeric resin materials utilized in the molding process can also be selected from a broad spectrum of materials such as a thermoset polyester, an epoxy, a vinyl ester or any other high performance polymeric resins.

Figure 2:
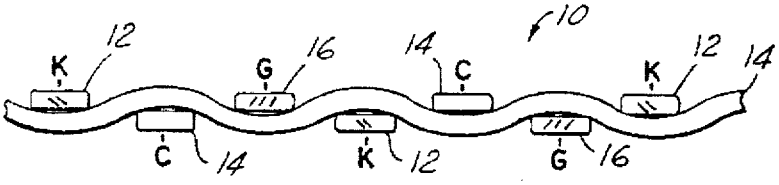
FIG. 2 is a side view of the reinforcing fabric shown in FIG. 1.

A side view of fabric 10 is shown in FIG. 2. It is seen that warp yarns of Kevlar® fiber yarn 12, carbon fiber yarn 14 and glass fiber yarn 16 are arranged in an alternating order both over and under weft yarn 14. It is to be noted that the total number of the various fiber yarns and their alternating sequence should be the same in the warp and in the weft direction such that a fabric, and subsequently a molded composite member, can have isotropic properties. A composite member having isotropic properties is desirable in most applications since it allows uniform thermal expansion or contraction, and it provides uniform mechanical properties that can be predicted during the design phase of a component.

Figure 3:
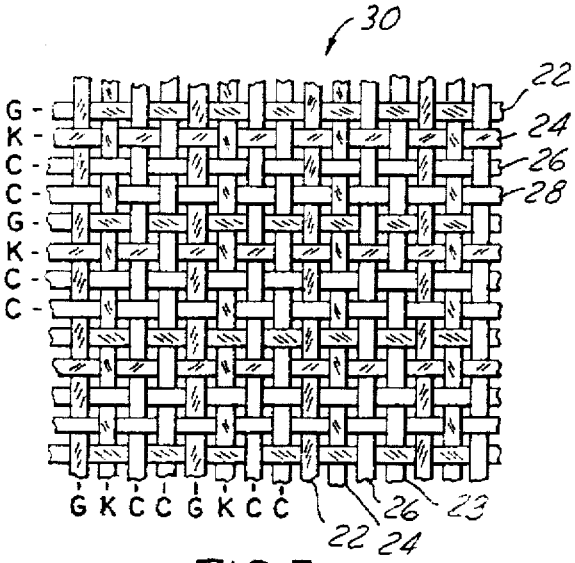
FIG. 3 is a plane view of a reinforcing fabric woven of an organic fiber yarn and three inorganic fiber yarns in both the warp and the weft directions.

The present invention allows a hybrid fabric to be woven with any desirable fiber yarn combination to suit a specific design criterion. As shown in FIG. 3, a fabric 30 is woven with one glass fiber yarn 22, one Kevlar® fiber yarn 24 and two carbon fiber yarns 26, 28 in alternating sequence in both the warp and the weft directions. Fabric 30 is more suitable for applications where a higher stiffness in the molded composite member is desired.

Figure 4:
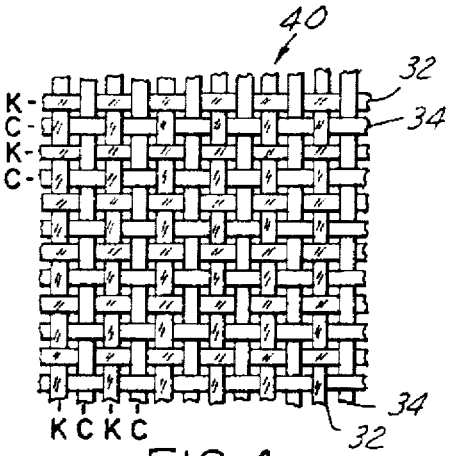
FIG. 4 is a plane view of a reinforcing fabric woven of a polyaramid fiber yarn and a carbon fiber yarn.

In other applications, it is possible that only two fiber yarns arranged in alternating sequence is required. For instance, FIG. 4 shows an alternate embodiment in which fabric 40 is woven with Kevlar® fiber yarn 32 and carbon fiber yarn 34 in alternating sequence. This fabric exhibits superior physical properties such as in strength, impact and stiffness. However, it is a higher cost fabric to produce due to the higher yarn costs.

Figure 5:
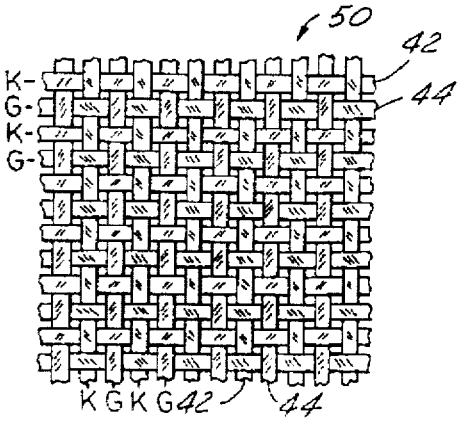
FIG. 5 is a plane view of a reinforcing fabric woven of a polyaramid fiber yarn and a glass fiber yarn.

FIG. 5 shows another alternate embodiment in which fabric 50 is produced with Kevlar® fiber yarn 42 and glass fiber yarn 44 in alternating sequence. The fabric is lower in cost to produce. However, it has a lower stiffness.

While the present invention has been described in an illustrative manner, it should be understood that the terminology used is intended to be in a nature of words of description rather than of limitation.

Furthermore, while the present invention has been described in terms of a preferred embodiment thereof, it is to be appreciated that those skilled in the art will readily apply these teachings to other possible variations of the invention. For instance, other suitable fiber yarns arranged in other suitable alternating sequence may also be used to achieve the same desirable results like those illustrated in the preferred and the alternate embodiments.

The embodiments of the invention in which an exclusive property or privilege is claimed are defined as follows:

1. A fabric comprising a single ply having woven warp and weft yarns, said warp comprises an organic fiber yarn and at least two inorganic fiber yarns in an alternating order, said weft comprises an organic fiber yarn and at least two inorganic fiber yarns in an alternating order, whereas the alternating order of said yarns in said warp and said weft are substantially the same, wherein said organic fiber is a polyaramid fiber and said at least two inorganic fibers comprise nickel coated carbon fiber and glass fiber.

2. A fabric according to claim 1, wherein said at least two inorganic fiber yarns further comprise carbon fibers in said warp and weft directions.

3. A fabric reinforced polymeric member made by a molding method comprising:

a single ply fabric having woven warp and weft yarns, said warp comprises an organic fiber yarn and at least two inorganic fiber yarns in an alternating order, said weft comprises an organic fiber yarn and at least two inorganic fiber yarns in an alternating order, whereas the alternating order of said yarns in said warp and said weft are substantially the same, wherein said organic fiber is a polyaramid fiber and said at least two inorganic fibers comprises nickel coated carbon fiber and glass fiber; and a polymeric resin material encapsulating said fabric.

4. A fabric reinforced polymeric member according to claim 3, wherein said polymeric resin material is selected from the group consisting of polyester, epoxy and vinyl ester resin materials.

* * * * *